United States Patent [19]

Hepfer et al.

[11] Patent Number: 4,508,456

[45] Date of Patent: Apr. 2, 1985

[54] STRIKING CLOCK WITH DEVICE FOR DISCONNECTING THE STRIKING MECHANISM

[75] Inventors: Rolf Hepfer, Bad Dürrheim; Jürgen Rünzler, Spaichingen, both of Fed. Rep. of Germany

[73] Assignee: Joseph Kieninger Uhrenfabrik GmbH, Fed. Rep. of Germany

[21] Appl. No.: 570,495

[22] Filed: Jan. 13, 1984

[30] Foreign Application Priority Data

Jun. 29, 1983 [DE] Fed. Rep. of Germany ..... 3323420

[51] Int. Cl.[3] ..... G04B 23/00

[52] U.S. Cl. ..... 368/262; 368/269; 368/273

[58] Field of Search ..... 368/262, 263, 243, 273, 368/75, 269, 270, 271

[56] References Cited

U.S. PATENT DOCUMENTS 4,396,297 8/1983 Akahane ..... 368/262

4,466,744 8/1984 Hepfer et al. ..... 368/262

*Primary Examiner*—Bernard Roskoski

*Attorney, Agent, or Firm*—McGlew and Tuttle

[57] ABSTRACT

In a striking clock having a striking mechanism, a release lever for releasing the striking mechanism to cause a striking of the clock, a barrel cam associated with the release lever for moving the release lever to release and retain the striking mechanism, a clockwork for rotating the barrel, and a lock disk driven one revolution in 24 hours by the clockwork, a device is provided for disconnecting the striking mechanism at any time, selectively and/or temporarily. The lock disk has a sector type lock cam which extends over a distance corresponding to about a 10 hour period on the lock disk. A feeler lever engages the lock disk and is moveable from a release position to a stop position when the feeler lever encountered the lock cam. A lock lever is couplable to the feeler lever and engageable with the release lever for moving the release lever to retain the striking mechanism when the feeler lever is in its stop position. A coupling lever is associated with the lock and feeler lever for selectively coupling and uncoupling the lock and feeler lever. A manually adjustable switch lever engages the coupling lever for moving the coupling lever into its uncoupling position at any time so that the striking mechanism can be released at any time, even when the feeler lever is engaged with the sector type lock cam of the lock disk.

10 Claims, 8 Drawing Figures

STRIKING CLOCK WITH DEVICE FOR DISCONNECTING THE STRIKING MECHANISM

FIELD AND BACKGROUND OF THE INVENTION

The present invention relates to a striking clock with a device for selectively and/or temporarily disconnecting the striking mechanism which is releasable by a releasing lever actuated by an hour barrel cam or by a quarter barrel cam, wherein a lock disk driven by the clockwork, revolving once in 24 hours, and provided with a sector type lock cam is provided, which lock disk is scanned by a feeler lever link with the releasing lever which alternately locks and releases the wheel-train of the striking mechanism.

A striking clock of the above mentioned kind is known, wherein both the clockwork and the striking mechanism are weight-driven and a lock disk is provided, the cam length of which corresponds, for instance, to a time interval of 10 hours. This lock disk is mounted on a pivot and is arranged so that if is in the pivotal range of a lever which is firmly connected to the releasing lever and that it prevents striking from being actuated when this lever applies against its peripheral edge. In addition, this lever has a manually operable latch assigned to it, with which the lever can be locked in its strike-inhibiting (silencing) position for any length of time, independently of the annular position of the lock disk.

In this known striking clock, the barrier which prevents striking cannot be lifted while the lock cam of the lock disk is operative. It only allows disconnecting the striking mechanism during the time sections not affected by the lock disk.

A striking clock is also known with a device for the selective and/or temporary prevention of gong or bell striking (German Patent Application No. P 31 48 853.6-31) where the action of the lock disk can be eliminated and restored at will and where, in contrast to the aforementioned known striking clock, the normal course of the striking mechanism can take place also when the lock disk is operative and prevents the gong or bell strikes. In this clock the lock disk is arranged in the pivotal range of a feeler lever which is fixed on an arbor which is driven by the striker mechanism through a lever and carries or actuates one or more hammers. The lock disk is displaceable as a whole and/or by sections in an axial direction out of the pivotal range of the feeler lever, and moreover of the arbor carrying or actuating the hammer or hammers, by means of a manually adjustable locking member. This striking clock, however, has only an hour and/or half-hour striking mechanism consisting of a single weight-or spring-driven wheelwork. For striking mechanisms with two or more wheelworks, that is for all four/four striking mechanisms, this known device for selective and/or temporary silencing of gongs or bells cannot be used because it can be effectively employed only for one wheel-train. Further, the wheel-train itself has no influence but exerts its strike-preventing function only by inhibiting the hammer or hammers.

In this cae of four/four striking mechanisms, e.g. one with Westminister chimes which strikes the quarter-hour, half-hour, three-quarter hour and full hour, there are two separate wheel-trains with separate drives which are actuated or controlled by two independent mechanisms, linked only by an hour release lever. At the quarter hour, half hour and three-quarter hour, one, two, or three sections of a four-tone melody are sounded, while on the full hour four melody sections with four tones are played and then the hour is struck. The melody sections use different hammers than are provided for the striking of the hour.

Then also there are four/four striking mechanisms with socalled melody rolls, on which for example five melody sections are played by appropriate arrangement of socalled nails in the form of radial pins which, by axial shifting of the respective roll, can be selectively brought into an operative position with respect to the hammers to be actuated. Also for such striking mechanism the known devices for disconnection of the striking mechanism are not suitable.

SUMMARY OF THE INVENTION

It is an object of the present invention to provide a striking clock with a device for selectively and/or temporarily disconnecting the striking mechanism of the initially mentioned kind which can be used for four/-four striking mechanisms with two wheel-trains, in such a way that in the one hand the striking mechanism is disconnected by means of the lock disk during the time interval corresponding to the length of the lock cam, but that on the other hand the action of the lock disk can be eliminated and restored at will also during the time the striking mechanism, which means that the striking mechanism can be manually turned on and off again at any time, for example also during the night that is, between 10 P.M. and 8 A.M. when it is turned off by the lock disk. Moreover it is also possible to turn off the striking mechanism manually altogether for any length of time, in known manner.

This problem is solved according to the invention in that, by a coupling lever which can be brought in and out of engagement with the feeler lever by means of a manually adjustable switching lever, the feeler lever can be coupled with a locking lever which is its locking position retains the releasing lever in its release-preventing position.

Thereby one achieves the desired advantage that the striking mechanism as a whole, that is both wheel-trains of the striking mechanism controlled by two cooperating releasing levers, can be turned on and off at any time regardless of the position of the lock disk. One also has the additional advantage that this is achieved at very low cost and with few simple parts which are easy to manufacture and easy to mount and which are also easy to operate.

The connection between the lock lever and the feeler lever which is especially simple and operationally safe is obtained, in a further development of the invention, in that the coupling lever is pivotably mounted on the lock lever by means of a hinge pin and that it comprises on the coupling arm directed toward the feeler lever a supporting shoulder which can be brought into engagement and held in engagement with a supporting element of the feeler lever by a spring.

According to another object of the invention, the coupling lever has a switching arm directed toward the switching lever and disengageable by the latter, and between the lock lever and the coupling lever there is a pin-and-slot connection which limits the angle of the pivoting movement of the coupling lever. In this way it is possible by the actuation of the coupling lever with the switching lever to exert at the same time also a force on the lock lever. The advantage of this is that with the uncoupling movement of the coupling lever, the lock lever is simultaneously pushed out of its locking position into its inoperative position, so that there can be no malfunctions upon elimination of the locking action during the normal disconnect time.

An especially favorable interplay between the feeler lever, coupling lever and lock lever is achieved in that the feeler lever and lock lever are mounted on a common bearing pin, each pivotable by itself, and form together with the feeler lever a triangle, the corners of which are formed by the bearing pin, by the hinge pin, and by the supporting element in engagement with the supporting shoulder.

In order that the striking mechanism can become automatically operative again during the usual disconnect time by a releasing oscillation of the switching lever, i.e. that the interrupted coupling between the coupling lever and the feeler lever can automatically become operative again and the supporting element of the feeler lever can automatically come in engagement again with the supporting shoulder of the coupling lever, it is provided in a further development of the invention, that the spring which holds the supporting element of the feeler lever is an extension spring engaging at the coupling arm of the coupling lever has a guide surface guiding the support element of the feeler lever into engagement with the supporting shoulder, which guide surface extends obliquely to the supporting shoulder.

For a spatially favorable arrangement of the entire disconnecting device on the front of the clockwork plate, i.e. on the side toward the dial, the lock lever has a locking arm which originates at the hinge pin and extends under a lateral projection of the releasing lever, and which in its inoperative position rests loosely on a stop pin. Appropriately the switching lever has, arranged on the arm thereof, a switching edge or switching surface which in one of at least two possible detent positions of the switching lever acts on the switching arm of the coupling lever in such a way that its coupling arm is held by the feeler lever in uncoupled position. The switching lever is further connected with a second arm which is able, in a third position, to disengage the hour hammer arbor by a lever attached thereon, in such a way that the arbor can no longer be actuated by the pin wheel associated with it.

Accordingly another object of the present invention is to provide a striking clock with a device for selectively and/or temporarily disconnecting the striking mechanism which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

An embodiment of the invention will now be explained more specificly with reference to the drawings, in which.

DESCRIPTION OF THE PREFERRED EMBODIMENT

Figures 1, 5, 6:
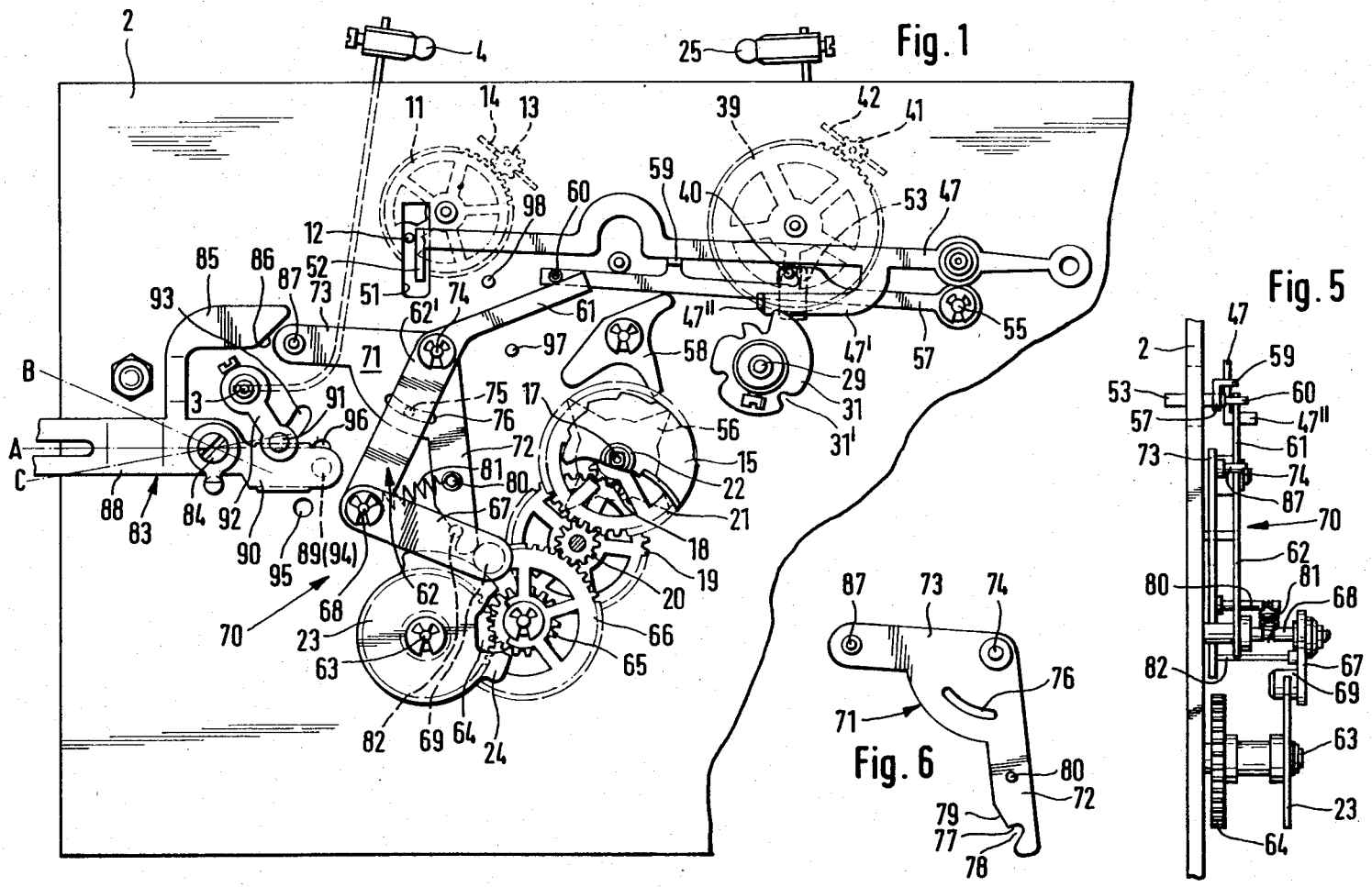
FIG. 1 is a partial front elevational view of the front plate of a striking clock with a silencing device and the releasing levers of a four/four striking mechanism with two wheel-trains.
FIG. 5 is a side elevational view of the silencing device, without the manual switching levers of the clock.
FIG. 6 is a front detail view of a coupling lever of the silencing device.

In the following it is assumed that those skilled in this field have knowledge of the construction and mode of operation of a four/four rack striking mechanism which consists of two wheel-trains, namely one for the quarter strike mechanism and one for the hour strike mechanism, and which comprises a group of hammers for the quarter strikes and a hammer or group of hammers for the hour strike. In FIGS. 1 to 4, only the parts belonging to the silencing device and the control elements of the striking mechanism directly acted upon or able to be acted upon directly by these parts are shown, insofar as they help to understand the invention. The two wheel-trains of the striking mechanism are indicated only by single wheels, while of the going train, which in such striking clocks is designed as a rule as a weightdriven pendulum train, only the minute wheel 16 (FIG. 4) with the minute arbor 17 and the dial train drive 18 to 21 with the hour barrel 22 are shown, as well as the drive derived therefrom for a lock disk 23 which controls the silencing device.

Figure 4:
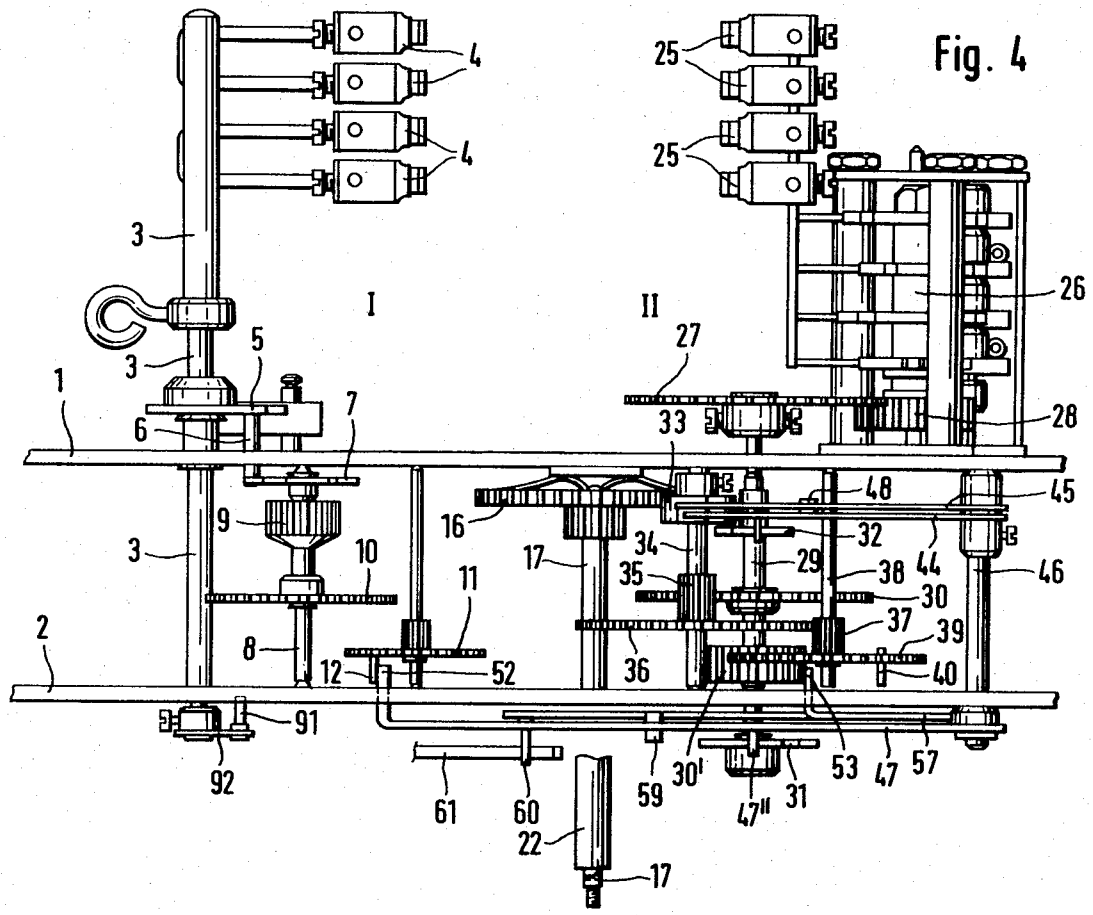
FIG. 4 is a top plan view of the hammer arrangement with parts of the two wheel-trains.

The wheel-trains of the striking clock are arranged essentially between two parallel plates 1 and 2 (FIG. 4). Of the hour striking mechanism there is shown the hour strike arbor 3, rotatably mounted in the two plates 1 and 2, with four hour strike hammers 4, which arbor is in engagement via lever 5 and a pin 6 with the socalled pin wheel 7, to be disengaged by the latter for execution of the strike when striking the hour. The pin wheel 7 in the present case, of a disk with a total of eight fingerlike teeth in star arrangement. The pin 6 normally engages with these teeth and, via pin 6 and lever 5, wheel 7 disengage the hour strike arbor 3 with the hour strike hammers 4, for execution of the lunging movement preceding the striking movement and subsequently let the arbor with hammers fall back for execution of the strike.

The pin wheel 7 sits on an arbor 8 which, rotatably mounted in the two plates 1 and 2 and provided with a pinion 9 and gear 10, is part of the hour strike wheel-train, to which belongs also the pin motion wheel 11 visible in FIGS. 1, 2, 3, and 4. The drive of this hour strike wheel-train is effected via a cable drum (not shown) by means of a weight which also is not shown. The pin motion wheel 11 with its releasing pin 12 is in direct engagement with the pinion 13 of a fly-vane 14 and is in drive connection with gear 10 via a so-called gathering pallet. The gathering pallet is not shown. It serves to move a so-called rack, which in cooperation with the so-called hour snail 15 determines the respective number of hour strikes, back by one tooth with each revolution in the pallet's striking position, in order to stop the hour strike wheel-train I until the next release, at the end of the given amount of switching or hour strikes, with the aid of a so-called drop lever, also not shown.

While the hour strike hammers 4 execute the striking movement jointly to create a four-voice gong beat, the quarter strike mechanism has four quarter hammers 25, each of which can be actuated separately by a pin barrel 26. This pin barrel 26 may be axially displaceable and provided with several axially offset pin groups associated with different tunes. The pin barrel 26 is driven by a gear 27 which meshes with a pinion 28 fastened on the pin barrel 26. Gear 27 is secured outside the plates 1 and 2 on a so-called locking plate shaft 29, on which are secured, besides a gear 30 and pinion 30' between plates 1 and 2, a stop disk 32 and, on the front side of plate 2, a so-called lock disk 31. An additional retaining disk 33 is fastened on an arbor 34, whose pinion 35 is in direct engagement with gear 30 of the locking plate shaft 29 and whose gear 36 meshes with a pinion 37 of an arbor 38 on which a pin motion wheel 39 with a release pin 40 is arranged non-rotationally. This pin motion wheel 39, too, meshes with the pinion 41 of a fly vane 42.

Figure 7:
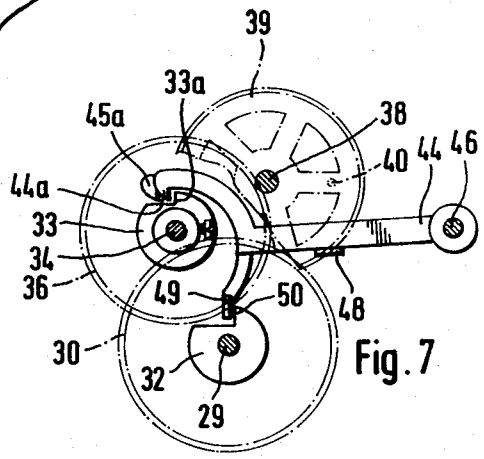
FIG. 7 is a front detail view of a part of the control mechanism of the quarter strike wheel-train and of the clock.

With the retaining disk 33, which has a rectangular cutout with a radial retaining shoulder **33*a*, there are in engagement sinultaneously two retaining lugs 44*a* and 45*a*, slightly offset relative to each other in the circumferential direction, of two stop levers 44 and 45 (see FIG. 7). Levers 44 and 45 are mounted on a so-called trigger shaft 46 of a first releasing lever 47. Lever 44 with the retaining lug 44*a* nearer the shoulder 33*a* is secured fixed on the trigger shaft 46, while the second stop lever 45 with the retaining lug 45*a* a little farther away from shoulder 33*a* is mounted loosely on trigger shaft 46. But stop lever 44 is provided with a cross tongue 48 engaging the stop lever 45 from below and raising the stop lever 45 as well when lever 44 is raised by the trigger shaft 46. Stop lever 45 has also a second retaining lug 49 which engages in a rectangular cutout with a radial retaining shoulder 50 of retaining disk 32 of the locking plate shaft 29**.

In conjunction with a second releasing lever 57, which is functionally associated with the first releasing lever 47, releasing lever 47 cooperating with lock disk 31 and the two stop levers 44 and 45 cooperating with the two stop disks 32 and 33 control the quarter strike wheel-train II in such a way that for the one/four strike, one, two, three, or four melodies are struck by the quarter hammers 25. For this purpose, lock disk 31 is provided with four radial notches 31', spaced from each other at intervals of 1/10, 2/10, 3/10 and 4/10 of the circumference of the entire lock disk 31. For feeling the lock disk 31, the releasing lever 47 has a secondary arm 47' with a feeler tongue 47'' extending at an angle. The transmission between pin barrel 26 and locking plate shaft 29 is 1:2, so that at 1/10 revolution of the locking plate shaft 29 the pin barrel 26 executes 1/5 revolution. Since there are five melody sections "nailed" on the pin barrel 26, one melody section (representing a quarter strike) is then struck.

The releasing lever 47, which is non-rotationally connected with the trigger shaft 46, has at its free end a retaining tongue 52, protruding through a slot opening 51 in plate 2 and extending at an angle, which, in cooperation with releasing pin 12 of the pin motion wheel 11 of the hour strike wheel-train I, controls the retention and release thereof.

The releasing pin 40 of pin motion wheel 39 of the quarter strike wheel-train II is acted upon by an angular retaining tongue 53 of the second stop lever 57, which tongue extends through a slot opening 54 in plate 2 into the circling path of releasing pin 40. The second releasing lever 57 is mounted freely pivoting on a bearing pin 40. The second releasing lever 57 is mounted freely pivoting on a bearing pin 55 disposed directly below the trigger shaft 46 in plate 2 and rests freely, that is, by its own weight, on a rocker arm 58 actuated by the quarter cam 56 of the minute wheel arbor 17. The second releasing lever 57 is equipped with a cross shoulder 59, on which the first releasing lever 47 rests loosely. In addition the second releasing lever 57 has at its free end a cross pin 60, under which engages a lock arm 61 of a lock lever 62 belonging to a silencing device 70. The actuation and control of the quarter and hour strikes is effected in known manner by the quarter cam 56 via the rocker arm 58 and the two releasing levers 47 and 57 or respectively the stop levers 44 and 45, in that the releasing pins 12, 40 of the pin motion wheels 11, 39 are either released or retained again by the lifting and re-dropping of the releasing levers 47 and 57.

The silencing device 70, which includes also the previously mentioned lock disk 23, serves to suppress the stike release of the striking mechenism during a certain time interval, e.g. between 10 P.M. and 8 A.M., so that there will be no disturbance during the night. But it is to be possible also to make the silencing device 70 operative or inoperative manually at will. In particular it is to be possible to bring the silencing device 70 from its inoperative position into its operative position and vice versa in a simple manner, for example by a switching lever, also within the time interval during which it normally keeps the striking mechanism turned off. The lock disk 23 with its lock cam 24 raised in the radial direction, which cam corresponds to a period of about 10 hours in one revolution of the lock disk 23, is rotatably mounted on a fixed pin 63 of plate 2 and is provided with a gear 64 linked with a pinion 65 of gear 66. Gear 66 in turn meshes with pinion 20 of the dial train. Associated with the lock disk 23 is a feeler lever 67, which is mounted for pivoting on a fixed bearing pin 68 of plate 2 and rests by its feeler 69 loosely on the circumference of lock disk 23 (See also FIG. 5).

On bearing pin 68 is mounted, also for free pivoting, i.e. pivoting independently of the feeler lever 67, the lock lever 62 with its lock arm 61, which lock arm forms with a lower section 62' of about the same length and extending obliquely upwardly, an angle alpha of about 140° so as to be able to engage the cross pin 60 of the releasing lever 57 from below.

Figure 2:
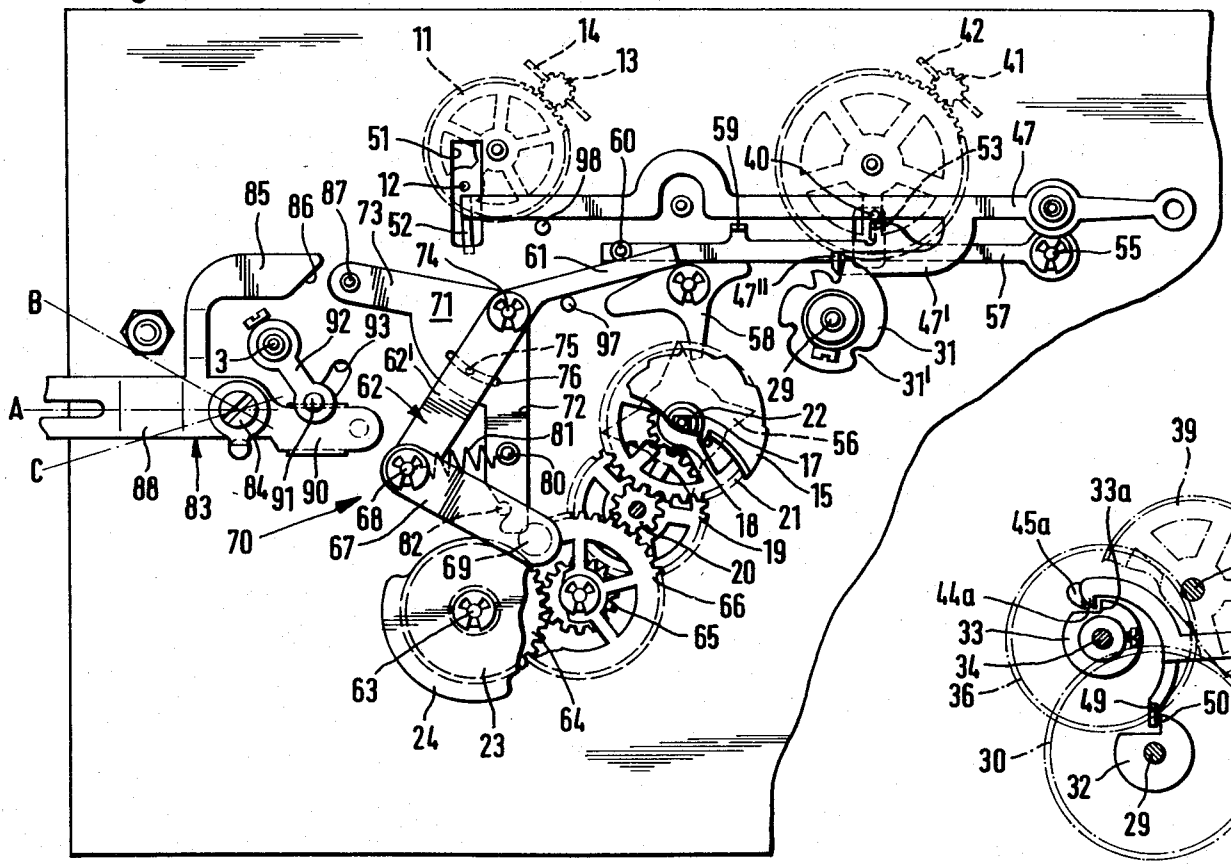
FIG. 2 is a view similar to FIG. 1, only in another operational position.

To establish a releasable connection between feeler lever 67 and lock lever 62, a coupling lever 71 is provided which comprises a coupling arm 72 and a switching arm 73 approximately at right angles thereto, and which at the common end of the arms 72, 73 is pivotably mounted by means of a hinge pin 74 in an appropriate bore at the upper end of the bottom part 62' of lock lever 62, and moreover by a pin-and-slot connection 75, 76 serving to limit the pivotal angle of coupling lever 71 relative to lock lever 62. Pin 75 is secured in lock lever 62, and the circular slot 76 is arranged in a sector of coupling lever 71 connecting the two arms 72 and 73. Near its lower end opposite hinge pin 74, the coupling arm has a supporting shoulder 77 which is formed by a corresponding recess 78 and contiguous to which there is an oblique guiding edge 79 on the inner side. In addition, the coupling arm 72 is provided with a pin 80 above the supporting shoulder 77 for hook-up of an extension spring 81, the other end of which is fastened to the hinge pin 68 on which the feeler lever 67 and lock lever 62 are mounted. In the normal position of coupling lever 71, the support shoulder 77 is in engagement with a supporting element 82, consisting of a pin, of the feeler lever 67, as is shown in FIGS. 1 and 2. This positive connection between the coupling lever 71 and the feeler lever 67 is established and maintained by the extension spring 81. It is seen from FIGS. 1 to 3 that the feeler lever 67, coupling arm 72 and lower part 62' of lock lever 62 form a triangle, the corners of which are formed by the hinge pin 74, bearing pin 68 and support element 82, and which as a whole can pivot about the bearing pin 68.

To be able to break the connection between feeler lever 67 and lock lever 62 existing due to the coupling lever 71 or its coupling arm 72, manually, as desired, so that the lock lever 62 will no longer follow the pivoting movements of the feeler lever 67, the switching arm 73 of the coupling lever 71 has associated with it a manually operable switching lever 83, which is pivotably mounted on a shoulder screw 84 seated in plate 2 and which comprises a bent secondary arm 85 which by an inclined switching surface 86 can act on a pin 87 of the switching arm 73. In addition, the switching lever has a slotted actuating arm 88 as well as a ratchet arm 90 with ball detent 89. Resting on this ratchet arm 90 is a pin 91 of a lever 92 fastened on the hammer arbor 3. Pin 91 protrudes into a slot opening 93 in plate 2 by which the pivoting movement of lever 92 is limited.

Associated with the ball detent 89 of ratchet lever 90 are three depressions 94, 95 and 96 in plate 2, by which the switching lever 83 can be locked in the three positions A, B and C. It would be sufficient also to provide only one depression 94 for the middle position A, the other two positions B and C of switching lever 83 being fixed by brake friction.

To make the description complete it should be mentioned also that there are arranged in plate 2, in the pivot range of lock arm 61, a support pin 97 and, above lock arm 61, another support pin 98 for the releasing lever 47.

The mode of operation of the silencing device 70, which consists essentially of lock disk 23, feeler lever 67, coupling lever 71, lock lever 62 and switching lever 83, is as follows:

In the position shown in FIG. 1, the switching lever 83 is in its middle or inoperative position A, in which it acts neither on the coupling lever 71 nor on the hour strike arbor 3. The ball detent sits in the central depression 94.

In this position of switching lever 83 the silencing device 70 is connected, i.e. is in operation. The continuously rotating lock disk 23 actuates the feeler lever 67 in such a way that after completion of the hour strike at 10 P.M. the feeler lever 67 is disengaged counterclockwise by the lock cam which extends over a peripheral length corresponding for instance to a period of 10 hours. At the same time, by the coupling arm 72 of lever 71 in positive connection with the supporting element 82 of feeler lever 67, lock lever 62 is pivoted out of the position shown in FIG. 2 into the position shown in FIG. 1, thereby bringing the two releasing levers 47 and 57 into their top position, in which the retaining tongue 52 blocks the releasing pin 12 of pin motion wheel 11 and tongue 53 blocks the releasing pin 40 of pin wheel 39. Both wheel-trains I and II are thereby blocked, so that the clockwork cannot strike. Only after feeler lever 67 has dropped off lock cam 24 again and in so doing has executed a clockwise motion, the two releasing levers 47 and 57 return to their normal operating position, shown in FIG. 2. In this position, the striking mechanism can perform its function unhindered with its two wheel-trains I and II and its hammers 4, 25.

Figure 3:
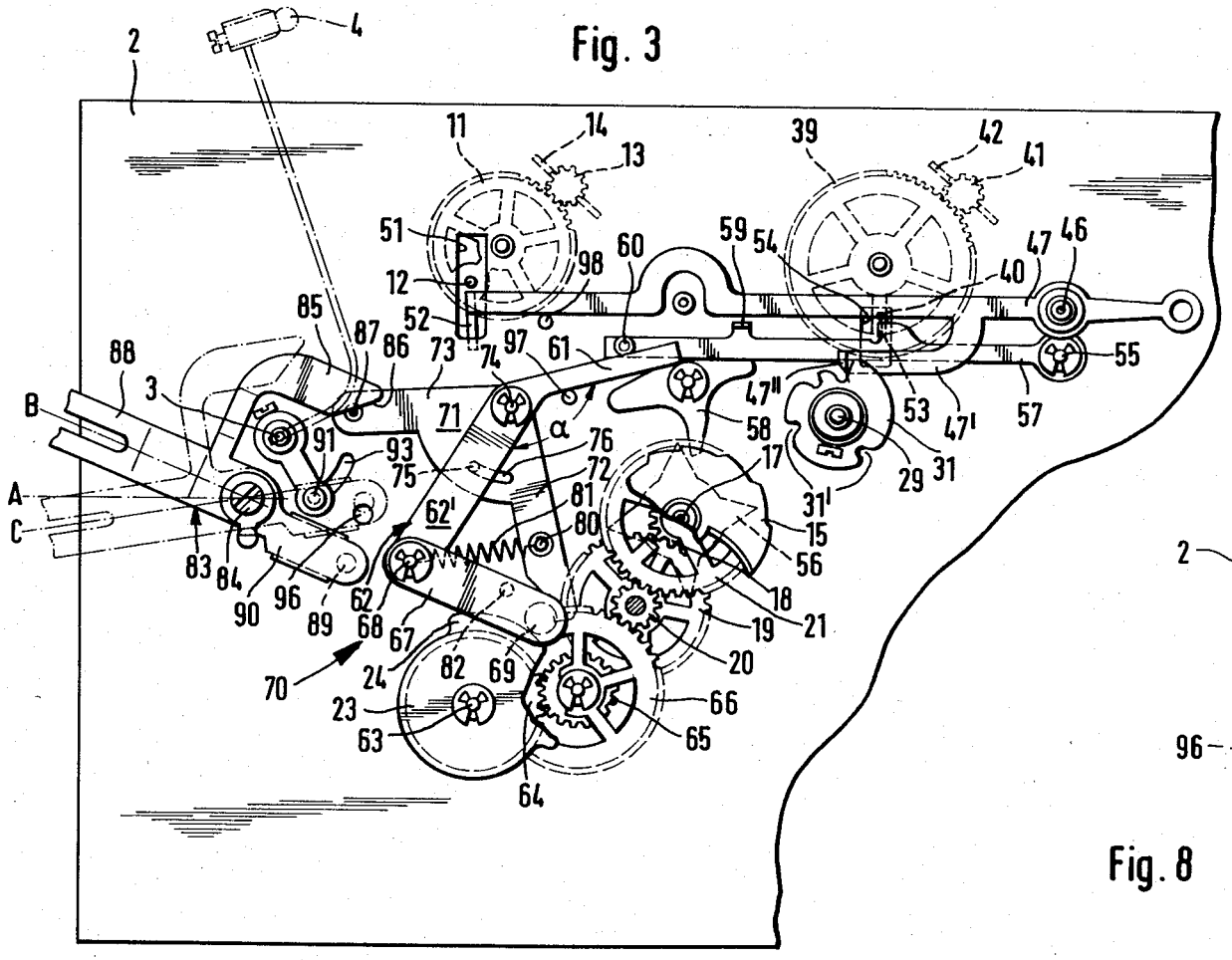
FIG. 3 is a view simular to FIGS. 1 and 2, in a third operational position.
Figure 8:
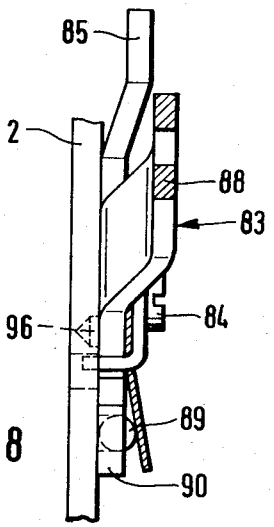
FIG. 8 is a partly sectional side view of a manuel switching lever.

But if, as shown in FIG. 3, the switching lever 83 is brought into position B, in which it stays due to the ball detent 89, the switching surface 86 of the secondary arm 85 of lever 83 pushes the switching arm 73 of coupling lever 71 downward, causing lever 71 to execute a counterclockwise motion about its hinge pin 74 by which coupling arm 72 comes out of engagement with the supporting element 82 of feeler lever 67 and thereby the connection between feeler lever 67 and lock lever 62 is broken. Hence the movements of feeler lever 67 are no longer transmitted to lock lever 62 and the silencing device 70 is switched off. This disconnection of the silencing device 70 can be effected at any desired time and hence also when the feeler lever is in disengaged position and its feeler pin 69 rests on lock cam 24.

By bringing the switching lever 83 out of position B of FIG. 3 into position A of FIG. 1 or FIG. 2, the switching arm 75 is let go again by the secondary arm 85 of switching lever 83, so that spring 81 can pull the coupling arm 72 ino engagement again with the supporting element 82 of feeler lever 67. This can take place also when feeler lever 67 is, as shown in FIG. 3, in its disengaged position, because the edge 79 steers the supporting element 82, consisting of a pin, into engagement with the supporting shoulder 77 of coupling arm 72 also in this shift position.

This means that the silencing device 70 can be turned on and off at any desired time and then immediately occupies the switch position which is programmed by the respective angular position of lock disk 23 at the respective time.

When switching lever 83 is brought to position C, its detent arm 90 raises up at the same time lever 92 of the hour strike arbor 3. Thereby the hour strike arbor 3 is pivoted counterclockwise from the angular position shown in FIG. 2 into the position shown in dash-dot lines in FIG. 3, in which the hour strike hammers are inhibited from executing a blow. In analogous manner a locking mechanism (not shown in the drawing) is provided also for the quarter strike hammer 25.

While a specific embodiment of the invention has been shown and described in detail to illustrate the application of the principles of the invention, it will be understood that the invention may be embodied otherwise without departing from such principles.

What is claimed is:

1. In a striking clock having at least one striking mechanism, at least one release lever for releasing the striking mechanism to cause striking of the clock and for retaining the striking mechanism to prevent striking of the clock, a barrel cam associated with the release lever for moving the release lever to release and retain the striking mechanism, a clockwork for rotating the barrel cam and a lock disk (23) driven one revolution in 24 hours by the clockwork, the lock disk having a sector type lock cam (24), a device for disconnecting the striking mechanism at any time, comprising:

a feeler lever (67) engaged with the lock disk and movable between a first released position and a second stop position when said feeler lever contacts the sector type lock cam;

a lock lever (62) couplable with said feeler lever and engagable with the release lever for moving the release lever to retain the striking mechanism when said feeler lever is in its stop position;

a coupling lever (71) associated with said lock and feeler levers and moveable from a coupling position to couple said feeler lever to said lock lever and an uncoupling position for uncoupling said feeler lever from said lock lever; and a manually movable switch lever (83) engageable with said coupling lever at any time for moving said coupling lever to its uncoupling position to uncouple said feeler lever from said lock lever to permit release of the striking mechanism.

2. A device according to claim 1, wherein said coupling lever is pivotably mounted to said lock lever by means of a hinge pin (74) and includes a coupling arm (72) directed towards said feeler lever and carrying a supporting shoulder (77), said feeler lever having a support element (82) engageable with said supporting shoulder, and a biasing spring (81) connected to said coupling arm for biasing said supporting shoulder into engagement with said support element, said manually moveable switch lever (83) engageable with said coupling lever to disengage said supporting shoulder from said support element against the bias of said biasing spring.

3. A device according to claim 1, wherein said coupling lever includes a switching arm (73) extending toward said switching lever and moveable by said switching lever to move said coupling lever, and a pin and slot connection (75,76) connected between said locking lever and said coupling lever for permitting a limited movement of said coupling lever before said coupling lever moves said lock lever.

4. A device according to claim 2, wherein said coupling lever includes a switching arm (73) extending toward said switching lever and moveable by said switching lever to move said coupling lever, and a pin and slot connection (75,76) connected between said locking lever and said coupling lever for permitting a limited movement of said coupling lever before said coupling lever moves said lock lever.

5. A device according to claim 2, including a plate, a common bearing pin (68) connected to said plate, said feeler lever and said lock lever both being pivotably mounted to said common bearing pin, said feeler lever, lock lever and coupling lever forming a triangle with one corner at said common bearing pin, another corner at said hinge pin (74) and a third corner at said supporting shoulder (77) when said supporting shoulder is engaged with said supporting element (82).

6. A device according to claim 4, including a plate, a common bearing pin (68) connected to said plate, said feeler lever and said lock lever both being pivotably mounted to said common bearing pin, said feeler lever, lock lever and coupling lever forming a triangle with one corner at said common bearing pin, another corner at said hinge pin (74) and a third corner at said supporting shoulder (77) when said supporting shoulder is engaged with said supporting element (82).

7. A device according to claim 5, wherein said spring (81) is connected between said coupling arm (72) and said common bearing pin (68), said spring comprising an extension spring for biasing said supporting shoulder into engagement with said support element, said coupling arm including a guide edge (79) adjacent said supporting shoulder for guiding said support element into said supporting shoulder, said guide edge extending obliquely to said supporting shoulder.

8. A device according to claim 1, including a plate, at least one stop pin (97) connected to said plate, the release lever having a lateral projection (60), said lock lever being pivotably mounted to said coupling lever at a hinge pin (74) and including a lock arm (69) engageable with said lateral projection, said lock arm having movement which is stopped by said stop pin.

9. A device according to claim 7, including a plate, at least one stop pin (97) connected to said plate, the release lever having a lateral projection (60), said lock lever being pivotably mounted to said coupling lever at said hinge pin (74) and including a lock arm (69) engageable with said lateral projection, said lock arm having movement which is stopped by said stop pin.

10. A device according to claim 1, wherein said manually moveable switch lever (83) includes a switching lever arm (85) with a switching edge (86), said coupling lever including a switching arm (73) engageable by said switching edge for moving said coupling lever, said switching lever having three positions (A,B,C) and detent means for holding said switching lever in each of said three positions, a first of said three positions placing said switching edge at a greatly spaced location from said switching arm, a second of said three positions placing said switching edge at a closely spaced location with respect to said switching arm, and a third of said three positions causing engagement of switching edge with said switching arm to move said coupling lever.

* * * * *